US009693647B2

(12) United States Patent
Ebenspanger

(10) Patent No.: US 9,693,647 B2
(45) Date of Patent: Jul. 4, 2017

(54) MIKVEH AND METHOD FOR CONSTRUCTING THEREOF

(71) Applicant: Gidon Israel Ebenspanger, Beit Nekofa (IL)

(72) Inventor: Gidon Israel Ebenspanger, Beit Nekofa (IL)

( * ) Notice: Subject to any disclaimer, the term of this patent is extended or adjusted under 35 U.S.C. 154(b) by 502 days.

(21) Appl. No.: 13/783,538

(22) Filed: Mar. 4, 2013

(65) Prior Publication Data

US 2013/0232681 A1 Sep. 12, 2013

(30) Foreign Application Priority Data

Mar. 7, 2012 (IL) ..... 218537

(51) Int. Cl.

| | |
|---|---|
| ***A47G 33/02*** | (2006.01) |
| ***E04B 1/66*** | (2006.01) |
| ***E04H 4/00*** | (2006.01) |

(52) U.S. Cl.

CPC ..... *A47G 33/02* (2013.01); *E04B 1/66* (2013.01); *E04H 4/0018* (2013.01); *E04H 4/0062* (2013.01); *E04H 2004/0068* (2013.01)

(58) Field of Classification Search

CPC ..... A47G 33/02; A47K 3/022; A47K 3/14; E04H 4/0031; E04H 4/0043; E04H 2004/0068; E04B 1/66

USPC ..... 4/505

See application file for complete search history.

(56) References Cited

U.S. PATENT DOCUMENTS

| | | | | |
|---|---|---|---|---|
| 3,193,847 | A * | 7/1965 | Mashura | E04H 4/0031 220/4.16 |
| 4,264,991 | A * | 5/1981 | Lasalandra | A47K 3/001 220/495.11 |
| 4,552,904 | A * | 11/1985 | Kadota | B29C 44/00 264/321 |
| 4,860,914 | A * | 8/1989 | Derni et al. | 220/4.28 |
| 5,720,056 | A * | 2/1998 | Aymes | E04H 4/005 4/488 |
| 6,647,562 | B1 * | 11/2003 | Arout et al. | 4/506 |
| 2009/0165201 | A1 * | 7/2009 | Vultaggio | E04H 4/0043 4/506 |
| 2011/0277488 | A1 * | 11/2011 | Peretz | 62/79 |

OTHER PUBLICATIONS

"Understanding Mikvah: Mikvah Construction" by Rabbi Schneur Zalman Lesches; http://www.mikvah.org/article/mikvah_construction; Dec. 26, 2010.*

"Secret of the Jew: Chapter 19" by Rabbi David Miller; http://homemikveh.org/sotj/ch19.html; Sep. 8, 2008.*

"Construction View 9" http://www.homemikveh.org/construction/constr_9.html; Jan. 13, 2007.*

* cited by examiner

*Primary Examiner* — Janie Loeppke

(74) *Attorney, Agent, or Firm* — Edward Langer, Adv. & Patent Attorney

(57) ABSTRACT

Constructing a mikveh by permanently fixing at least one initial building unit to the ground of an installation site, connecting, in a sealed manner, additional building units to the initial building unit(s), for producing a sealed vessel, where the length of each of most of said building units is at least 50 centimeters, and the weight per area thereof is less than 250 kg per square meter.

17 Claims, 8 Drawing Sheets

MIKVEH AND METHOD FOR CONSTRUCTING THEREOF

CROSS-REFERENCE TO RELATED APPLICATIONS

This application claims priority under 35 U.S.C. §119 to Israel Patent Application No. 218537, filed Mar. 7, 2012, the disclosure of which is incorporated herein by reference.

FIELD OF THE INVENTION

The present invention relates to the field of mikvehs. More particularly, the invention relates to a method for constructing thereof.

BACKGROUND OF THE INVENTION

A mikveh is a bath used for the purpose of full-body ritual immersion in Judaism. The mikveh's present-day main uses are by women after menstruation, by men (customary only), for conversion to Judaism, and for food utensils.

"In Orthodox Judaism these regulations are steadfastly adhered to, and consequently the mikveh is central to an Orthodox Jewish community, and they formally hold in Conservative Judaism as well. The existence of a mikveh is considered so important in Orthodox Judaism, that an Orthodox community is required to construct a mikveh before building a synagogue, and must go to the extreme of selling Torah scrolls or even a synagogue if necessary, to provide funding for the construction" (from Wikipedia http://en.wikipedia.org/wiki/Mikveh)

"A mikveh must, according to the classical regulations, contain enough water to cover the entire body of an average-sized person; based on a mikveh with the dimensions of 3 cubits long, 1 cubit wide, and 1 cubit deep, the necessary volume of water was estimated as being 40 seah of water. The exact volume referred to by a seah is debated, and classical rabbinical literature only specifies that it is enough to fit 144 eggs; most Orthodox Jews use the stringent ruling of the Avrohom Yeshaya Karelitz, according to which one seah is 14.3 litres, and therefore a mikveh must contain approximately 575 litres. This volume of water could be topped up with water from any source, but if there were less than 40 seahs of water in the mikveh, then the addition of 3 or more pints of water from an unnatural source would render the mikveh unfit for use, regardless of whether water from a natural source was then added to make up 40 seahs from a natural source; a mikveh rendered unfit for use in this way would need to be completely drained away and refilled from scratch. There are also classical requirements for the manner in which the water can be stored and transported to the pool; the water must flow naturally to the mikveh from the source, which essentially means that it must be supplied by gravity or a natural pressure gradient, and the water cannot be pumped there by hand or carried. It was also forbidden for the water to pass through any vessel which could hold water within it (however pipes open to the air at both ends are fine) as a result, tap water could not be used as the primary water source for a mikveh, although it can be used to top the water up to a suitable level. To avoid issues with these rules in large cities, various methods are employed to establish a valid mikveh. One is that tap water is made to flow over the top of a kosher mikveh, and through a conduit into a larger pool. A second method is to create a mikveh in deep pool, place a floor with holes over that and then fill the upper pool with tap water. Like this the person dipping is actually "in" the pool of rain water. Most contemporary mikvehs are indoor constructions, involving rain water collected from a cistern, and passed through a duct by gravity into an ordinary bathing pool; the mikveh can be heated, taking into account certain rules, often resulting in an environment not unlike a spa." (from Wikipedia http://en.wikipedia.org/wiki/Mikveh)

The present-day mikvehs are based on the Jewish regulations (such as those written in Shulchan Aruch Yoreh Deah 201:2) according to which a permissible mikveh constitutes a structure built on the ground or on a building, even on a top floor thereof, since it is connected and is regarded associated to the ground.

Customarily, most mikvehs are dug within the ground, for eliminating the need of climbing thereinto.

Shulchan Aruch Yoreh Deah 201:7 allows as well another embodiment, described as follows. At the first step, a vessel is produced. At the second step, the vessel is hollowed, for avoiding in principle the capability of the vessel to contain the water, thus canceling the facility or instrument thereof. At the third step, the vessel having the hole is fixed to the ground or to the building. At the fourth step the hole is filled and clogged.

This embodiment is cheap and convenient. However, this vessel embodiment actually is not applied, since the permissibility thereof is doubted by other legal scholars (thoroughly discussed in Pithei Thshuva on Shulchan Aruch Yoreh Deah 201:7). The consideration of this doubt is that said hollowing is not sufficiently significant, and that the vessel remains a "tool" (the Jewish regulation term is "Kli") receiving impurity in the aspect of a mikveh.

Thus, constructing a mikveh is a very expensive matter, such that a mikveh is normally a public building.

All the methods described above have not yet provided satisfactory solutions to the problem that constructing a mikveh is a very expensive issue.

It is an object of the present invention to provide a method for making the issue of constructing a mikveh more easily available and inexpensive.

It is an object of the present invention to provide a solution to the above-mentioned and other problems of the prior art.

Other objects and advantages of the invention will become apparent as the description proceeds.

SUMMARY OF THE INVENTION

In one aspect, the present invention is directed to a method for constructing a mikveh (10), the method comprising the steps of:

- permanently fixing at least one initial building unit (22) to the ground (28) or to a stationary substance of an installation site;
- connecting, in a sealed manner, additional building units (22) to the at least one initial building unit (22) and if necessary also one (22) to the other (22), for producing a sealed vessel (52);
- inserting into the vessel (52) at least one partition (16) having water transition (18), for partitioning thereof to at least one basin (30) comprising at least the minimal required volume of a mikveh according to the Jewish regulation, and to
- at least one immersion pool (20) comprising a volume sufficient for immersion,
- wherein the length of each of most of the building units (22) is at least 50 centimeters and the weight per area thereof is less than 250 kg per 1 square meter, thereby applying a modular and relatively lightweight technology, being permissible by Jewish regulation for a mikveh (10), rather than the conventional heavy construction technology.

The method may further comprise the steps of:

filling the at least one basin (30) with water regarded as natural by Jewish regulation; and filling the immersion pool (20) with tap water.

The step of fixing at least one initial building unit (22) to the ground (28) may comprise fixing by screws (38).

The step of fixing at least one initial building unit (22) to the ground (28) may comprise:

providing a permanent base to the ground; and sticking the at least one initial building unit (22) to the permanent base by glue or by an adhering material.

The step of connecting, in a sealed manner, additional building units (22) to the at least one initial building unit (22) and if necessary also one (22) to the other (22) may comprise: sticking the building units (22) therebetween by glue or by an adhering material.

The step of connecting, in a sealed manner, additional building units (22) to the at least one initial building unit (22) and if necessary also one (22) to the other (22) may comprise: interlacing between the building units (22) and embracing them together.

The step of connecting, in a sealed manner, additional building units (22) to the at least one initial building unit (22) and if necessary also one (22) to the other (22) may comprise casting.

In another aspect, the present invention is directed to a mikveh (10) comprising:

a vessel (52) comprising a plurality of basic units (22) connected therebetween in a sealed manner, wherein the length of each of most of the building units (22) is at least 50 centimeters and the weight per area thereof is less than 250 kg per 1 square meter, and wherein at least one of the plurality of basic units (22) is permanently fixed to the ground or to a stationary substance of an installation site of the installation site, prior to production of the vessel (52); and at least one partition (16) within the vessel (52) providing water transition (18), for partitioning thereof to at least one basin (30) comprising at least the minimal required volume of a mikveh according to the Jewish regulation, and to at least one immersion pool (20), comprising a volume adapted for immersion;

thereby applying a modular technology, being permissible by Jewish regulation for a mikveh (10), rather than the prior art's heavy construction technology.

Each of the basic units (22) may comprise a plate.

The plate (22) may be curved, forming a curved wall (54), thereby minimizing the number of plates (22) and the number of connections therebetween.

Each of the basic units (22) may comprise a beam.

The fixing of the at least one of the plurality of basic units (22) to the ground of the installation site may comprise fixing by screws (38).

The connection of the plurality of basic units (22) therebetween in a sealed manner may comprise sticking therebetween by glue or by an adhering material.

The connection of the plurality of basic units (22) therebetween in a sealed manner may comprise interlacing between the building units (22) and embracing them together.

The connection of the plurality of basic units (22) therebetween in a sealed manner may comprise casting.

The material of the basic unit (22) may comprise a member selected from a group including: plastic, thermoplastic, polycarbonate, perspex, coal fiber, nanomaterial, thereby the vessel (52) is regarded as earth, not receiving impurity according to Jewish law.

The material of the basic unit (22) may comprise glass.

The material of the basic unit (22) may comprise a heat insulating material, thereby providing efficient heating of the water contained in the vessel (52).

The entire wall of the vessel (52) may be a single unit constituting the basic unit (22) not having a bottom.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF THE DRAWINGS

Embodiments and features of the present invention are described herein in conjunction with the following drawings.

It should be understood that the drawings are not necessarily drawn to scale.

DETAILED DESCRIPTION OF THE INVENTION

The present invention will be understood from the following detailed description of preferred embodiments, which are meant to be descriptive and not limiting. For the sake of brevity, some well-known features, methods, systems, procedures, components, circuits, and so on, are not described in detail.

Figure 1:
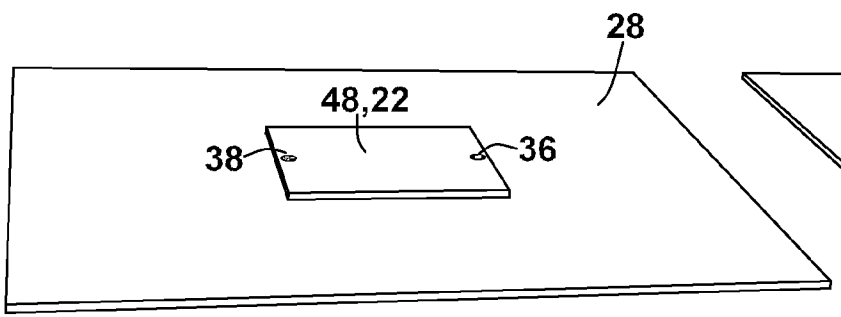
FIG. 1 depicts the first step of making a mikveh, according to one embodiment of the present invention.

FIG. 1 depicts the first step of making a mikveh, according to one embodiment of the present invention.

A mikveh according to the present invention includes a bottom 48 and walls 54 forming a vessel, which are built while being connected to the ground 28 or to a stationary substance of the installation site. Ground 28 refers to the veritable ground or to a floor of a building. The stationary substance may refer to a wall being an integral built part of a building or to a concrete casting connected to the floor or to the ground.

One advantage of this inventive vessel for the application of the mikveh over the prior art mikveh is that, in the view of Jewish regulations, the essence of this vessel has never been a facility or an instrument, but it is rather built on the ground from the creation thereof.

In contrast to prior art mikvehs the basic building unit 22 of the mikveh according to the present invention is "large" and "lightweight", thus providing lightweight modular construction.

Recently, the Jewish regulations have been analyzed and approved that this lightweight modular technology is indeed permissible for a mikveh, as it is not regarded as a vessel having the problems described in the background chapter.

According to the embodiment of FIG. 1, a mikveh 10 includes a bottom 48 including at least one building unit 22 and a plurality of walls 54, each including at least one building unit 22.

Each of building units 22 is larger than basic building units of conventional building units, being bricks or blocks. The length of basic building unit 22 of the present invention is at least 50 centimeters, thus it provides modular building.

However, building units 22 are of relatively lightweight materials, such as wood, plastic, thermoplastic, polycarbonate, perspex, glass or others, rather than concrete or similar.

For example, concrete requires a thickness of about 15 centimeters for holding water, thus 1 square meter requires a volume of 0.15 $m^3$ having, based on the density of concrete of about 2500 $kg/m^3$, the weight of 375 kg.

In contrast, glass requires a thickness of about 6 centimeters for holding water, thus 1 square meter requires a volume of 0.06 $m^3$ having, based on the density of glass of about 2500 $kg/m^3$, the weight of 150 kg. Perspex requires a thickness of about 6 centimeters for holding water, thus 1 square meter requires a volume of 0.06 $m^3$ having, based on the density of perspex of about 1200 $kg/m^3$, the weight of 72 kg.

Thus, in order to differentiate the modular construction from concrete, and other relatively heavy materials, the weight per an area unit may herein is estimated to be not more than 250 kg per 1 square meter.

In the embodiment of FIG. 1, where building units 22 constitute plates, not only the length is greater than 50 centimeters, but also the width is larger.

Preferably, the area of each of plate(s) 22 is as large as may be available, for minimizing the number of plates 22 and the number of connections therebetween. For example, the area of each plate 22 being the building unit is 80 centimeters×80 centimeters.

At the first step a plate 22 is permanently fixed to the ground 28 forming bottom 48.

According to one embodiment, the ground 28 may constitute bare earth. According to this embodiment the fixing may involve inserting screws 38 through holes 36 at the side of 22 of bottom 48. Screws 38 are preferably covered.

According to another embodiment, ground 28 may constitute a permanent base to the ground, which may be a paved floor or a concrete casting, allowing sticking plate 22 of bottom 48 by glue or another adhering material.

The requirement is that the vessel will not be movable, even when being empty. A strict preferable requirement is that moving the vessel requires breaking it.

Figure 2:
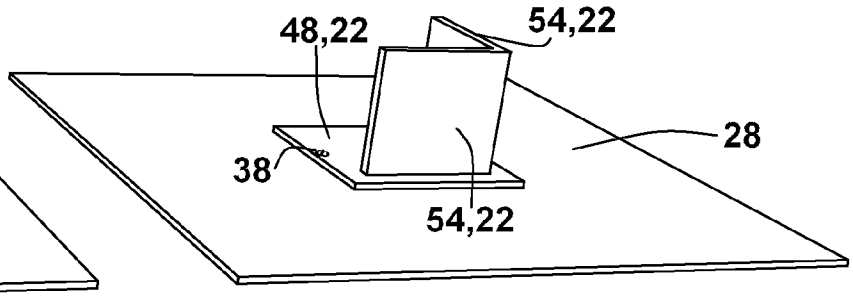
FIG. 2 depicts the second step of making a mikveh, according to the embodiment of FIG. 1.

FIG. 2 depicts the second step of making a mikveh, according to the embodiment of FIG. 1.

At the second step, plates 22 of walls 54 are connected to plate(s) 22 of bottom 48 and to one another in a sealed manner. Bottom 48 together with the walls 54, form a vessel 52, capable of containing water.

According to one embodiment, the sealed connection of plates 22 therebetween may use glue or another adhering material, or, especially for plastic plates, it may apply casting.

Bottom 48 may include a plurality of plates having a sealed connection therebetween. As well, each of the walls may include a plurality of wall plates 54 having a sealed connection therebetween.

Figure 3:
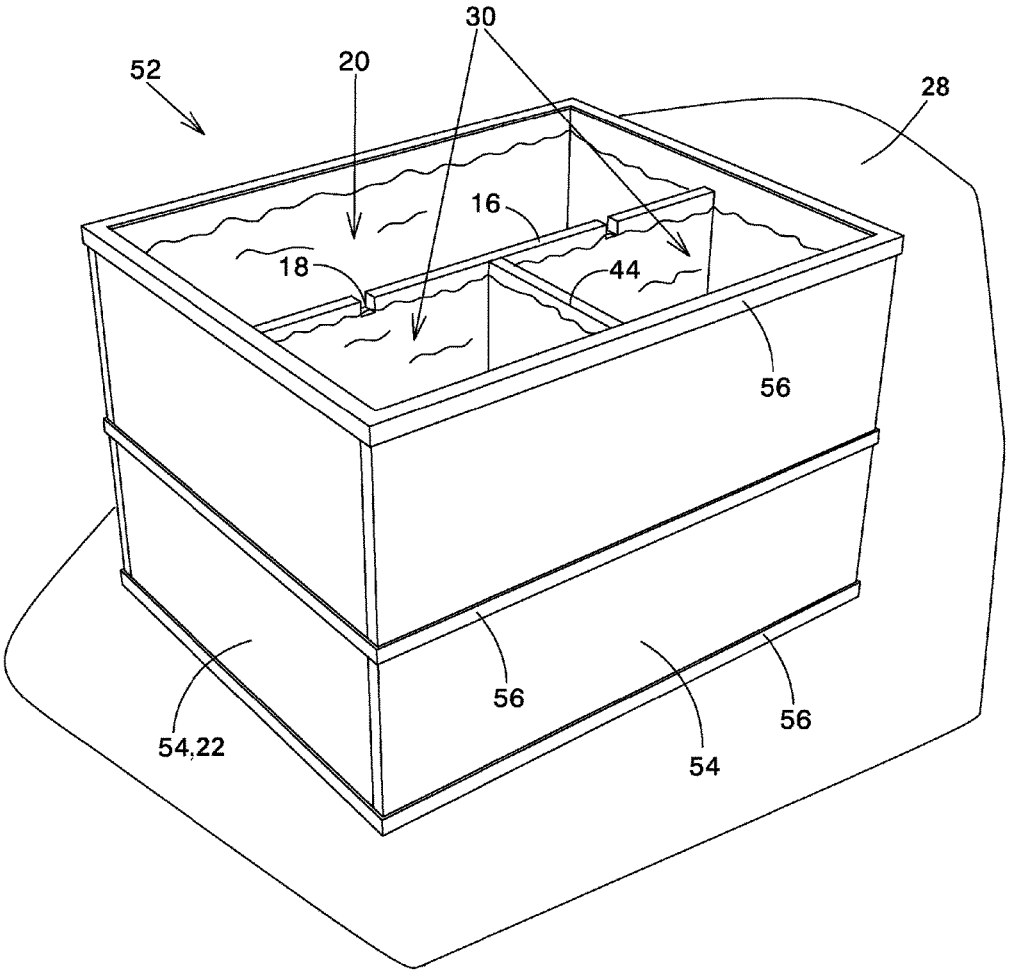
FIG. 3 depicts the third step of making a mikveh, according to the embodiment of FIG. 1.

FIG. 3 depicts the third step of making a mikveh, according to the embodiment of FIG. 1.

According to one embodiment, embracing bars 56 surrounding walls 54, may support the sealed connection. Preferably embracing bars 56 are stuck by glue for belonging to walls 54.

At the third step, at least one partition 16 is inserted into vessel 52.

According to the example of FIG. 3 partitions 16 and 44 form an immersion pool 20, in which the persons immerse, and two basins 30, each having a relatively small opening 18 to immersion pool 20, which may be a hole or half of a hole for providing transition of water.

Partition(s) 16 are typically connected in a sealed manner for allowing emptying pool 20 without emptying vessel 30. Opening 18 is typically located at a height above the minimal water volume required for basin 30, thus upon emptying pool 20 the water of basin 30 does not flow to pool 20.

Basin 30 is covered most of the time for avoiding entrance of unnatural water, such as tap water, and also for providing cleanliness of the water.

Vessel 52 including all the pools 20 and basins 30, is regarded as the vessel constituting the mikveh, in the eyes of the Jewish law.

Figure 4:
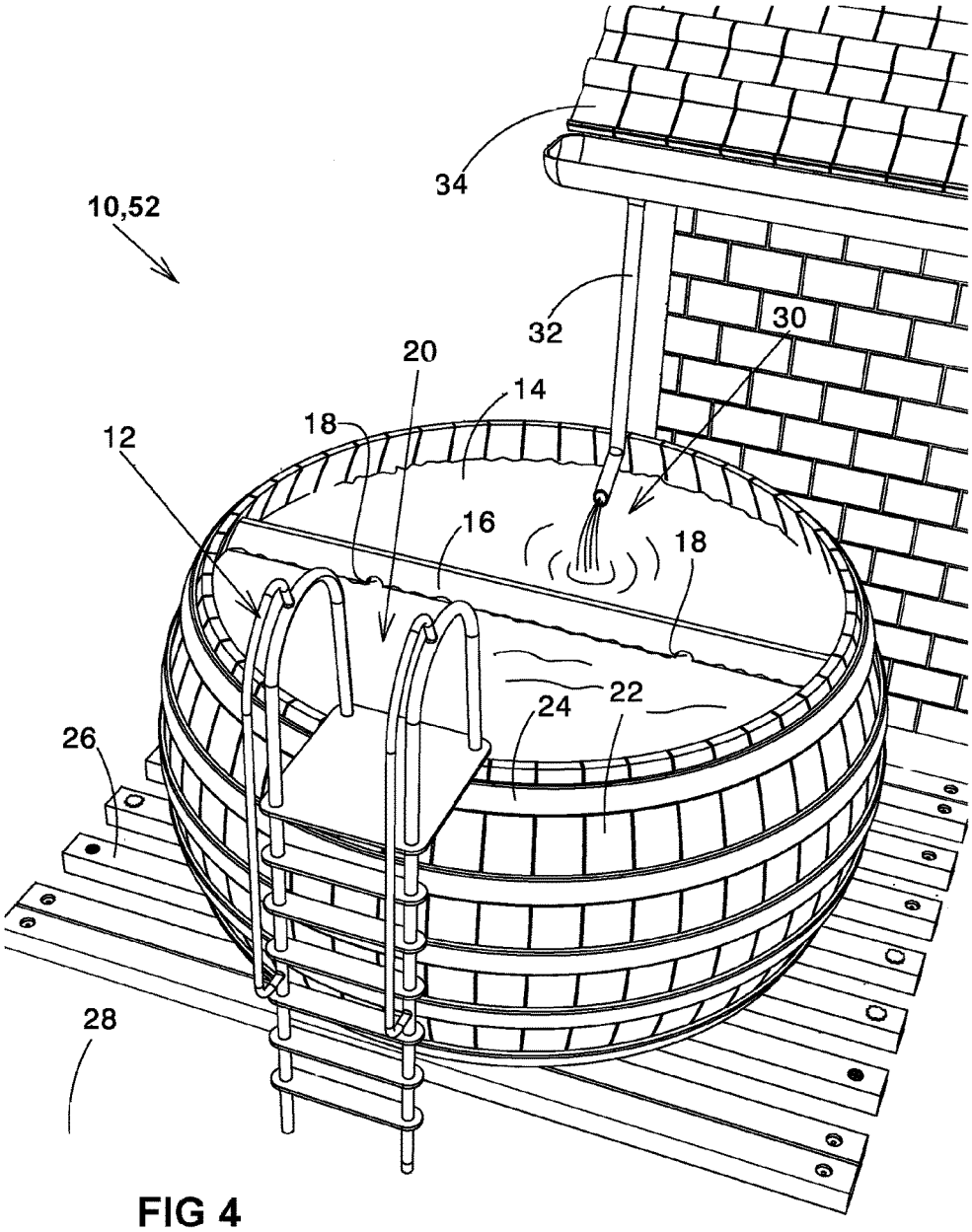
FIG. 4 demonstrates the difference between the compartments of FIG. 3.

FIG. 4 demonstrates the difference between the compartments of FIG. 3.

Basins 30 initially contain water which is regarded according to Jewish regulations as natural source water. According to the preferred prior art embodiment the natural water constitutes rain water which is spilled by gravity from a roof 34, which may have a rain gutter 32 for collecting the water into basin 30.

Partition(s) like partition(s) 16 of FIGS. 3 and 4 are present in a prior art mikveh. They are intended to make a physical separation between compartments, for allowing replacing the water of immersion pool 20, while keeping the natural-regarded water of basins 30. Due to osculation (the Jewish regulation term is "Hashaka") with the natural water of basin 30 through opening(s) 18, after filling fresh unnatural water from a tap into immersion pool 20, this fresh water may again be regarded as natural water, eligible for ritual immersion.

Additional basins 30 may be present as in prior art mikvehs, for applying other approaches, such as the approach named "Zri'ah" (literal translation: seeding), for connecting the unnatural water of immersion pool 20 with the natural-regarded water of basin 30, by flowing tap water to immersion pool across natural water of basin 30. In strict mikvhes two basins 30 are present, one for the Hashaka and one for the Zri'ah.

Unlike most prior art mikvehs, vessel 52 is disposed above the ground 28, thus immersion pool 20 may be supported with a ladder 12 for climbing from ground 28 to the top of vessel 52. An additional ladder may be placed at the other side, which is within vessel 52. However, like conventional mikvehs, mikveh 10 of the present invention may be built within a pothole.

Figure 5:
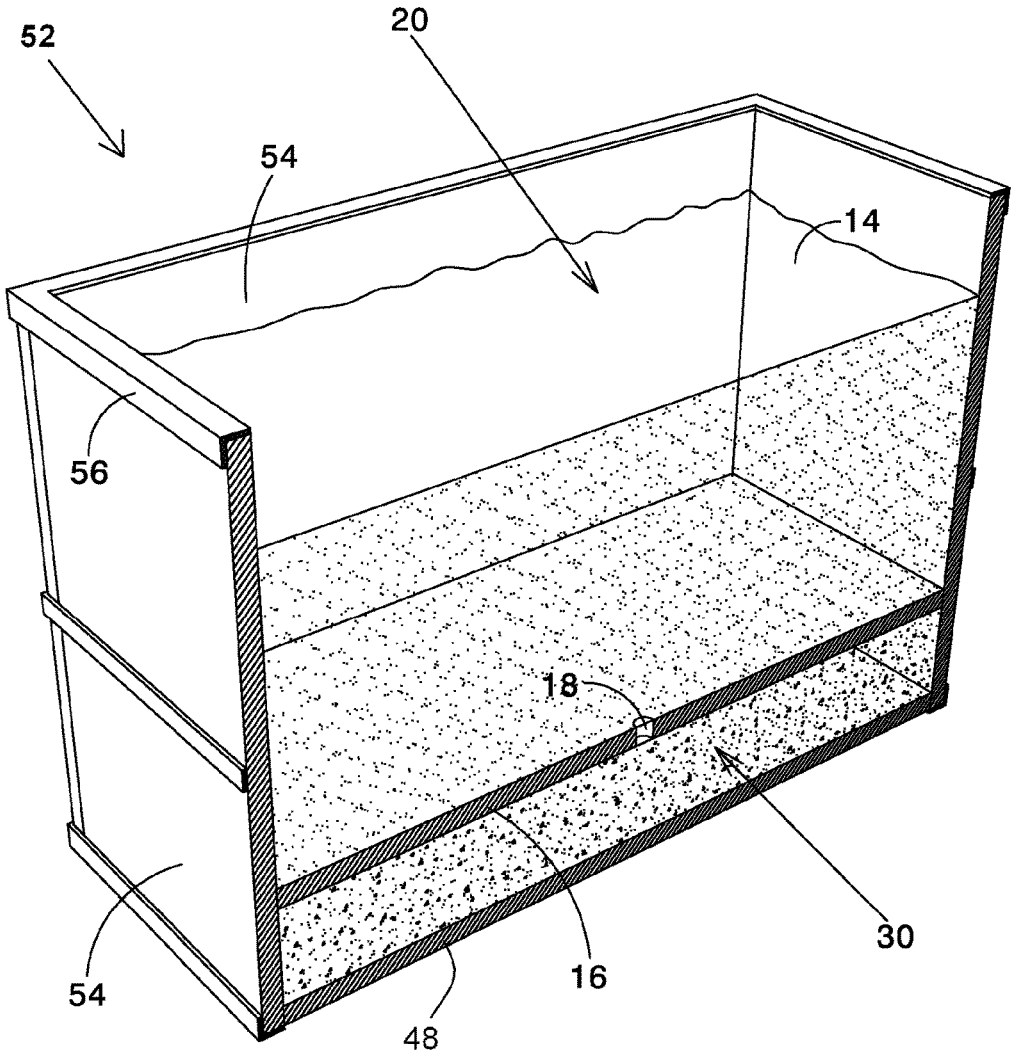
FIG. 5 is a sectional perspective view of the vessel of FIG. 3 having a horizontal partition, instead of the vertical partition of FIG. 3.

FIG. 5 is a sectional perspective view of the vessel of FIG. 3 having a horizontal partition, instead of the vertical partition of FIG. 3.

Another prior art structure includes a partition 16 disposed horizontally between immersion pool 20 and natural water basin 30. This structure may also be applied by the mikveh 10 of the present invention.

The following describes the steps of using mikveh 10 of FIG. 5. At the beginning vessel 52 is dry. At the first step, partition 16 is removed, and water is naturally spilled onto bottom 48. Upon having the required amount of 40 seah of water, which is the minimal required amount, at the second step, partition 16 having opening (18) is disposed horizontally like a shelf. At the third step, unnatural water 14 is filled above partition 16 forming immersion pool 20 thereabove. The users stand on partition 16 for immersing.

Basin 30 is inherently covered according to this embodiment.

This embodiment is very convenient for immersing food utensils (see background chapter), by reducing the volume of immersing pool 20 such that the distance from the top of the water to horizontal partition 16 does not exceed the length of a hand. Thus, unintentional release of a utensil drops it to partition 16, allowing raising the utensil by hand.

Basic building unit 22 of bottom 48 and of walls 54 of vessel 52 of FIGS. 1, 2, 3 and 5 preferably is a composite material such as plastic. According to one embodiment the plastic is Poly(methyl methacrylate) (PMMA), known as "perspex". Basic building unit 22 may be of a nanomaterial, coal fiber or another material.

These materials are preferred, since some Jewish scholars regard them as "earth", which do not receive impurity, even if serving a classical vessel or tool. From the same consideration, according to another embodiment the material may be glass. These materials are advantaged of being lightweight and of insulating the heat of the water.

Figure 6:
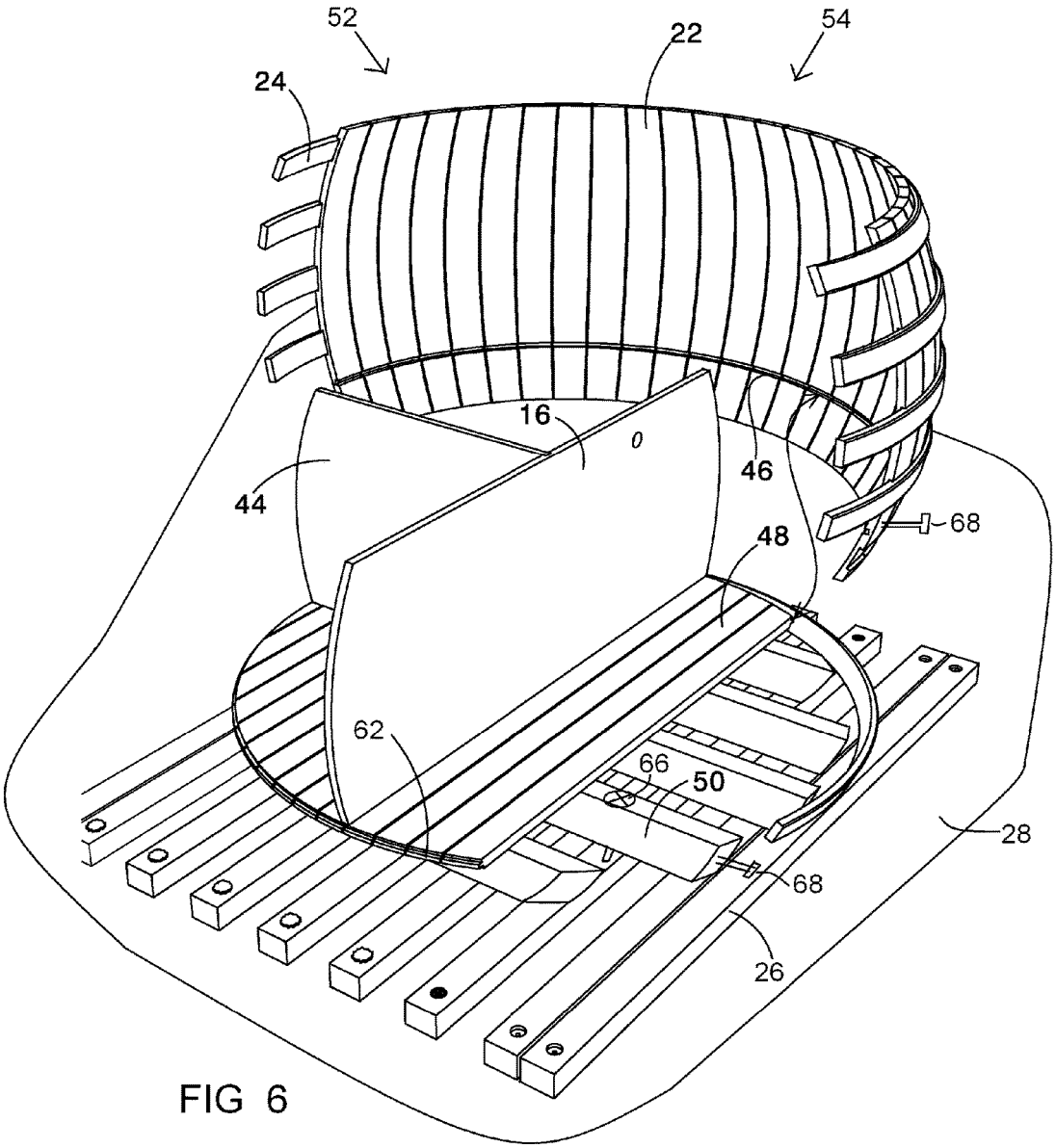
FIG. 6 depicts the first step of making a mikveh, according to another embodiment of the present invention.

FIG. 6 depicts the first step of making a mikveh, according to another embodiment of the present invention.

According to the embodiment of FIG. 6, bottom 48 and walls 54 are made of wood beams 22, being the basic building units. The length of each of beams 22 is at least 50 centimeters.

Beams 22 interlace one with the other, forming walls 54; beams 22 interlace one with the other, forming bottom 48; and the ends 62 of beams 22 of bottom 48 interlace with depressions 46 of beams 22 of walls 54, for holding bottom 48 by walls 54.

Bottom 48 and walls 54 form together a vessel 52 of a type of barrel. However, the steps provide that the connection to the ground is before the barrel is produced.

Depressions 46 are disposed above the bottom of walls 54, thus beams 22 of walls 54 are disposed on the ground 28, elevating beams 22 of bottom 48 thereabove.

At the first step, beams 26 are laid on the ground 28, and are permanently fixed thereto. At the second step, beams 50 are laid on beams 26, and are connected to beams 26, such as by screws 66. At the third step, the bottoms of some of beams 22 are fixed to the sides of beams 50 by screws 68. At the fourth step, beams 22 of bottom 48 are placed on beams 50. Beams 50 support beams 48 in the middle. At the fifth step, partitions 16 and 44 are placed on horizontal beams 48. At the sixth step, beams 22 are interlaced forming vessel 52, thus all beams 22 are regarded as connected to the ground prior to constituting vessel 52. Rings 24 embrace beams 22 of walls 54.

Figure 7:
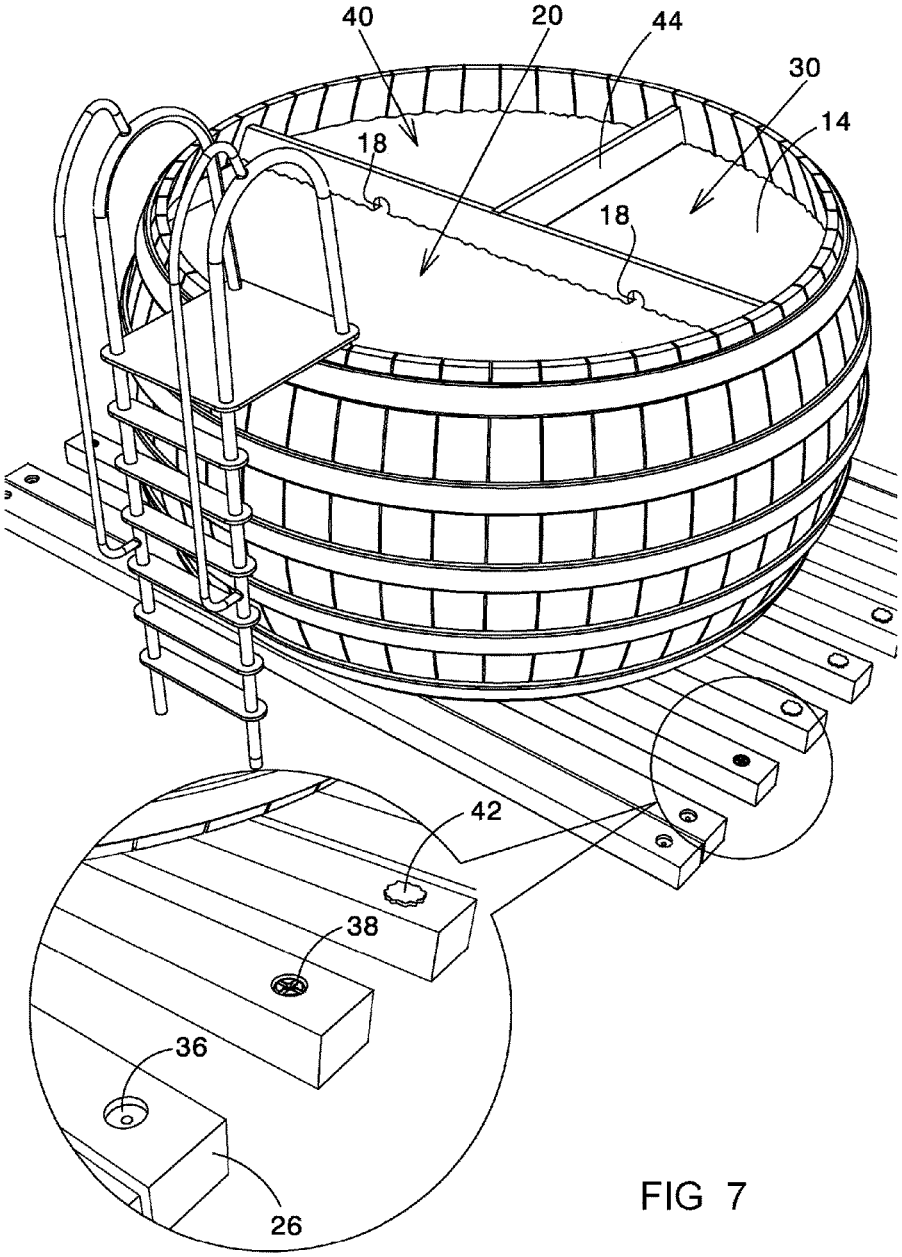
FIG. 7 depicts the seventh step of making a mikveh, according to the embodiment of FIG. 6.

FIG. 7 depicts the seventh step of making a mikveh, according to the embodiment of FIG. 6.

At the seventh step, screws 38 are covered by a filling 42.

Figure 8:
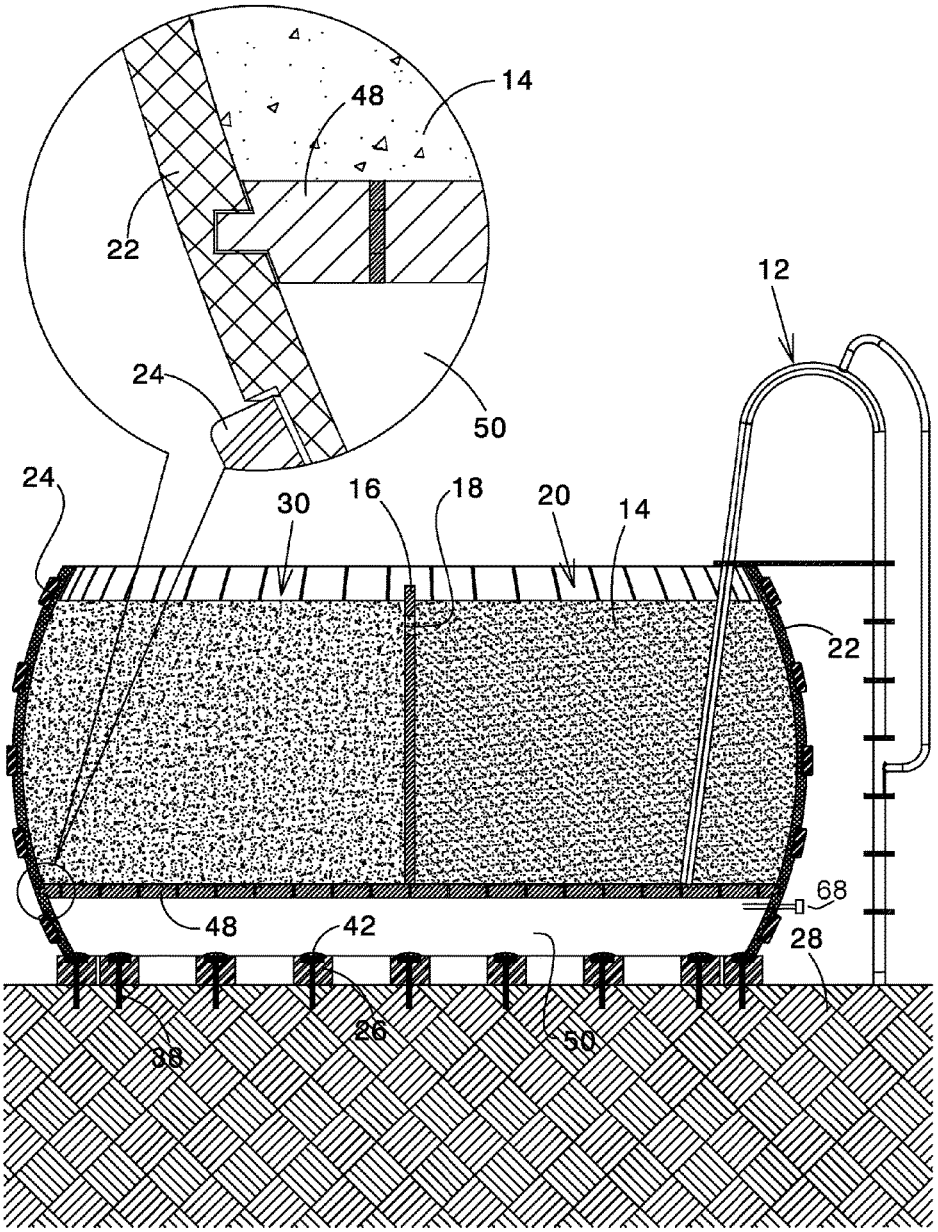
FIG. 8 is a sectional view of the mikveh of FIG. 6.

FIG. 8 is a sectional view of the mikveh of FIG. 6.

At the inner side horizontal beam 22 of bottom 48 is depicted being interlaced into beam 22 of wall 54. At the outer side, rings 24 are depicted embracing beams 22 of walls 54. The embracing provides firm contact of beams 22 one to the other, such that the interlacing between them provides sealed connection therebetween.

Figure 9:
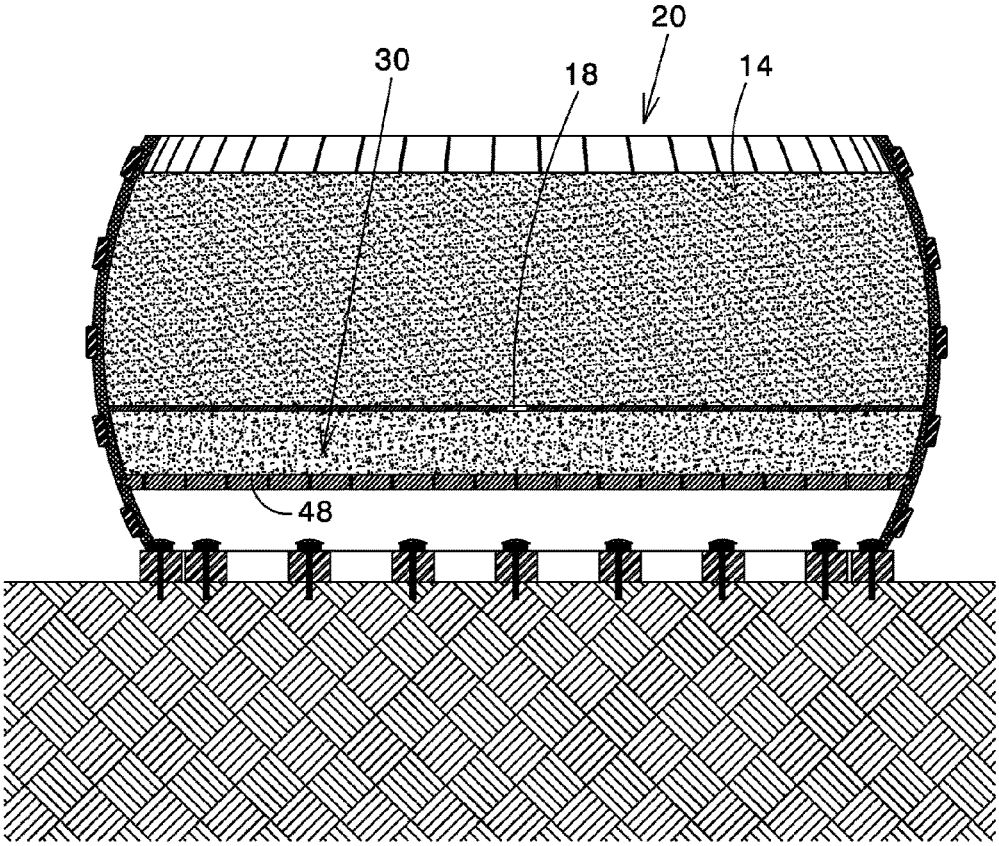
FIG. 9 is a sectional view of the mikveh of FIG. 6, but having a horizontal partition having an opening 18, like FIG. 5.

FIG. 9 is a sectional view of the mikveh of FIG. 6, but having a horizontal partition having an opening 18, as in FIG. 5.

Figure 10:
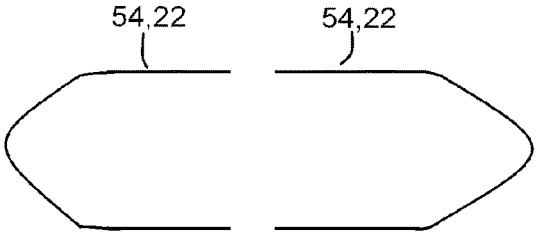
FIG. 10 is a top view of the walls of a mikveh, depicting another embodiment.

FIG. 10 is a top view of the walls of a mikveh, depicting another embodiment.

According to the embodiment depicted in FIG. 10, a basic building unit 22 of wall 54 may be curved. This embodiment allows reducing the number of building units 22 that must be connected together in a sealed manner.

Vessel 52 may have any other shape, e.g., a triangle.

Figure 11:
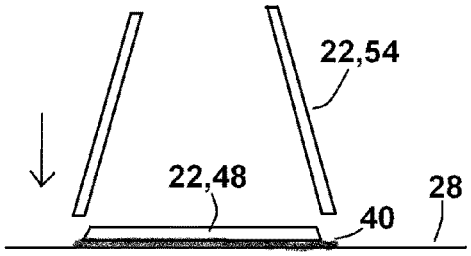
FIG. 11 shows an example in which the entire wall of vessel 52 includes one building unit only.

FIG. 11 shows an example in which the entire wall of vessel 52 includes one building unit only.

According to this example, at the first step bottom 48 including a single building unit 22 is connected by glue 40 to the ground. Then at the second step a single building unit 22 shaped as a cup not having a bottom is pushed down towards bottom 48. This embodiment is advantaged of providing intrinsic sealing by pre-fitting the wall 54 to the bottom 48.

In the figures and/or description herein, the following reference numerals have been mentioned:

- numeral 10 denotes a mikveh according to one embodiment of the present invention;
- numeral 12 denotes a ladder;
- numeral 14 denotes water;
- numeral 16 denotes a partition;
- numeral 18 denotes an opening between a water basin and an immersion pool;
- numeral 20 denotes an immersion pool;
- numeral 22 denotes the basic building unit of the vessel; the building unit may be a beam or a plate or a curved plate, or having another shape; the length therealong thereof is at least 50 centimeters;
- numeral 24 denotes a ring embracing the walls;
- numeral 26 denotes a beam laid on the ground;
- numeral 28 denotes the ground;
- numeral 30 denotes a basin containing water not for immersion;
- numeral 32 denotes a rain gutter;
- numeral 34 denotes a roof;
- numeral 36 denotes a hole for threading a screw;
- numeral 38 denotes a screw;
- numeral 40 denotes glue;
- numeral 42 denotes filling of a hole, for covering the screw;
- numeral 44 denotes a partition;
- numeral 46 denotes a depression;
- numeral 48 denotes the bottom of the vessel;
- numeral 50 denotes a beam;
- numeral 52 denotes a vessel;
- numeral 54 denotes a wall of the vessel;
- numeral 56 denotes a bar for embracing the walls;
- numeral 62 denotes the end of the beam; and
- numerals 66 and 68 denote screws;

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A method for constructing a Mikveh (10) said method comprising the steps of:

permanently fixing at least one initial building unit (22) to the ground (28) or to a stationary substance of an original installation site, using connecting means;

connecting, in a sealed manner, additional building units (22) to said at least one initial building unit (22) and to each other (22), for producing a sealed vessel (52);

inserting into said vessel (52) at least one partition (16) comprising a water transition area (18), for partitioning thereof to (a) at least one basin (30), and to (b) at least one immersion pool (20), wherein said immersion pool is exposed for direct contact with natural water to be filled therein, and the length of each of a majority of said building units (22) is at least 50 centimeters and the weight per area thereof is less than 250 kg per 1 square meter, wherein each of said building units (22) of said vessel are made of a member of the group of lightweight materials consisting of: plastic, thermoplastic, polycarbonate, perspex, coal fiber, and nanomaterial, wherein said connecting means is provided as a screw covered by filler material, for preventing access to said screw, and wherein said permanently fixing is performed in such fashion as to require that at least one of said connecting means and said vessel lightweight materials are visibly broken when dismantling said vessel, such that said vessel cannot be reconstructed at another installation site.

2. A method according to claim 1, further comprising the steps of:

filling said at least one basin (30) with natural water; and filling said immersion pool (20) with tap water.

3. A method according to claim 1, wherein said step of fixing at least one initial building unit (22) to the ground (28) comprises fixing by screws (38).

4. A method according to claim 1, wherein said step of fixing at least one initial building unit (22) to the ground (28) comprises:

providing a permanent base to the ground; and sticking said at least one initial building unit (22) to said permanent base by glue or by an adhering material.

5. A method according to claim 1, wherein said step of connecting, in a sealed manner, additional building units (22) to said at least one initial building unit (22) comprises: sticking said building units (22) therebetween by glue or by an adhering material.

6. A method according to claim 1, wherein said step of connecting, in a sealed manner, additional building units (22) to said at least one initial building unit (22) comprises: interlacing said building units (22) to each other.

7. A method according to claim 1, wherein said step of connecting, in a sealed manner, additional building units (22) to said at least one initial building unit (22) comprises casting.

8. A mikveh (10) comprising:

a vessel (52) comprising a plurality of basic units (22) connected therebetween in a sealed manner, wherein the length of each of a majority of said basic units (22) is at least 50 centimeters and the weight per area thereof is less than 250 kg per 1square meter, and wherein at least one of said plurality of basic units (22) is permanently fixed to the ground or to a stationary substance of an installation site at the installation site using connecting means, prior to production of said vessel (52); and at least one partition (16) within said vessel (52) providing water transition (18), for partitioning thereof to at least one basin (30), and to at least one immersion pool (20);

wherein said immersion pool is exposed for direct contact with natural water to be filled therein, wherein each of said basic units (22) of said vessel are made of a member of the group of lightweight materials consisting of: plastic, thermoplastic, polycarbonate, perspex, coal fiber glass, and nanomaterial, wherein said connecting means is provided as a screw covered by filler material, for preventing access to said screw, and wherein said at least one permanently fixed basic unit (22) is arranged to require that at least one of said connecting means and said vessel lightweight materials are visibly broken when dismantling said vessel, such that said vessel cannot be reconstructed at another installation site.

9. A mikveh (10) according to claim 8, wherein each of said basic units (22) comprises a plate.

10. A mikveh (10) according to claim 9, wherein said plate (22) is curved, forming a curved wall (54).

11. A mikveh (10) according to claim 8, wherein each of said basic units (22) comprises a beam.

12. A mikveh (10) according to claim 8, wherein said fixing of said at least one of said plurality of basic units (22) to the ground of the installation site comprises fixing by screws (38).

13. A mikveh (10) according to claim 8, wherein said connection of said plurality of basic units (22) therebetween in a sealed manner comprises sticking therebetween by glue or by an adhering material.

14. A mikveh (10) according to claim 8, wherein said plurality of basic units (22) therebetween in a sealed manner is carried out by interlacing members of said plurality of basic units (22) to each other.

15. A mikveh (10) according to claim 8, wherein said connection of said plurality of basic units (22) therebetween in a sealed manner comprises casting.

16. A mikveh (10) according to claim 8, wherein the material of said basic unit (22) comprises a heat insulating material, thereby providing efficient heating of the water contained in said vessel (52).

17. A mikveh (10) according to claim 8, wherein the entire wall of said vessel (52) is a single unit constituting said basic unit (22) not having a bottom.

* * * * *